United States Patent [19]

Kaman

[11] 4,090,427

[45] May 23, 1978

[54] STRINGED MUSICAL INSTRUMENT BODY

[76] Inventor: Charles H. Kaman, Prattling Pond Rd., Farmington, Conn. 06032

[21] Appl. No.: 698,955

[22] Filed: Jun. 23, 1976

[51] Int. Cl.[2] ..... G10D 1/08

[52] U.S. Cl. ..... 84/291

[58] Field of Search ..... 84/173, 267, 275, 291, 84/292

[56] References Cited

U.S. PATENT DOCUMENTS

| | | | |
|---|---|---|---|
| 1,863,344 | 6/1932 | Lange | 84/267 |
| 3,443,466 | 5/1969 | Brakewell | 84/291 |
| 3,474,697 | 10/1969 | Kaman | 84/291 |

*Primary Examiner*—Lawrence R. Franklin

*Attorney, Agent, or Firm*—McCormick, Paulding & Huber

[57] ABSTRACT

In a stringed musical instrument body, such as for a guitar, the top plate or soundboard of the body is attached to the sidewall by an elongated mounting member extending along the marginal edge of the soundboard and between such marginal edge and the adjacent upper edge of the sidewall. The mounting member resiliently supports the top plate and influences its natural frequency. The rounded shape of the mounting member avoids the otherwise sharp corner occurring at the front edge of the instrument body, and the mounting member is preferably made of a molded plastic which may include a molded ornamental design on its outer visible surface.

5 Claims, 5 Drawing Figures

STRINGED MUSICAL INSTRUMENT BODY

BACKGROUND OF THE INVENTION

This invention relates to the construction of hollow bodies for guitars and other stringed musical instruments, and deals more particularly with an improvement in said construction involving the attachment of the top plate to the sidewall.

In musical instrument bodies, the natural frequency of the top plate, in place in the completed body, is known to have a profound influence on the tonal characteristics of the instrument, and commonly the top plate is designed to have a particular selected natural frequency to provide the instrument with what is thought to be its most pleasing sound. The achievement of a particular natural frequency in a given top plate is, however, usually quite difficult and generally requires considerable skilled hand work in graduating the top plate, shaving its bracing or otherwise slightly modifying its physical makeup.

The general object of this invention is, therefore, to provide a construction for a stringed musical instrument body wherein the natural frequency of the top plate is modified and may be controlled by the means attaching it to the adjacent side-wall of the body. In particular, the top plate is attached to the sidewall by an intermediate mounting member or ring which resiliently supports the top plate relative to the sidewall. The resiliency of the mounting member may be readily controlled by design factors to produce different members of different "springiness". Therefore, by matching a given top plate with a mounting member of proper springiness, a desired top plate natural frequency may be readily obtained without the need to graduate or otherwise rework the top plate.

The mounting member of the present invention may be used with musical instruments bodies made of various different materials, but it has a particular advantage in conjunction with an instrument body including a top plate, such as a top plate including face laminations of a graphite fiber-resin composite material as shown in U.S. Pat. No. 3,880,040, which once fabricated is difficult to rework.

Another object of this invention is to provide a musical instrument body construction having a mounting means for the top plate which has the effect of lowering the natural frequency of the top plate below the natural frequency which would be obtained by conventional constructions thereby allowing the top plate to be of a stiffer character than would otherwise be the case.

Another object of the invention is to provide a musical instrument body having a more comfortable feel than most present instrument designs insofar as the relatively sharp corner normally existing at the marginal edge of the top plate is eliminated.

A still further object of the invention is to provide a musical instrument of the foregoing character wherein an attractive ornament or design may be applied to the top edge of the instrument body by simply molding such design into a plastic mounting member used to attach the top plate to the body sidewall.

Other objects and advantages of the invention will be apparent from the following detailed description and from the drawings and claims forming a part thereof.

In the claims and the description which follow, relative orientation terms, such as "vertical", "horizontal", "top" and "upper" are used with the assumption that the body in question is positioned with its top plate horizontal and facing upwardly as in FIG. 2.

SUMMARY OF THE INVENTION

The invention resides in a stringed musical instrument body, such as that for a guitar, having a generally horizontal top plate and a vertical sidewall, and particularly involves the top plate being attached to the sidewall by a mounting member or ring which extends along the entire marginal portion of the top plate and resiliently supports the top plate from the sidewall so as to allow the top plate marginal edge portion to vibrate relative to the sidewall. The marginal edge portion of the top plate is spaced a substantial distance inboard of the top edge of the sidewall and the mounting member has an intermediate portion extending between the sidewall top edge and the top plate marginal edge with the intermediate portion having a relatively small thickness and being made of a resilient material so as to be deformable in a bending mode to accommodate vertical vibration of the top plate marginal edge portion relative to the sidewall. The springiness of the mounting member may be varied by varying the thickness of its intermediate portion, to suit the particular top plate with which it is used. Preferably, the mounting member is made of a molded plastic material, such a composite material consiting of fiberglass fibers and resin, and has curved outer surface providing the instrument body with a comfortable round top edge. The outer surface of the mounting member also may include an attractive ornamental design to imporve the appearance of the instrument.

DETAILED DESCRIPTION OF THE PREFERRED EMBODIMENT

Figure 1:
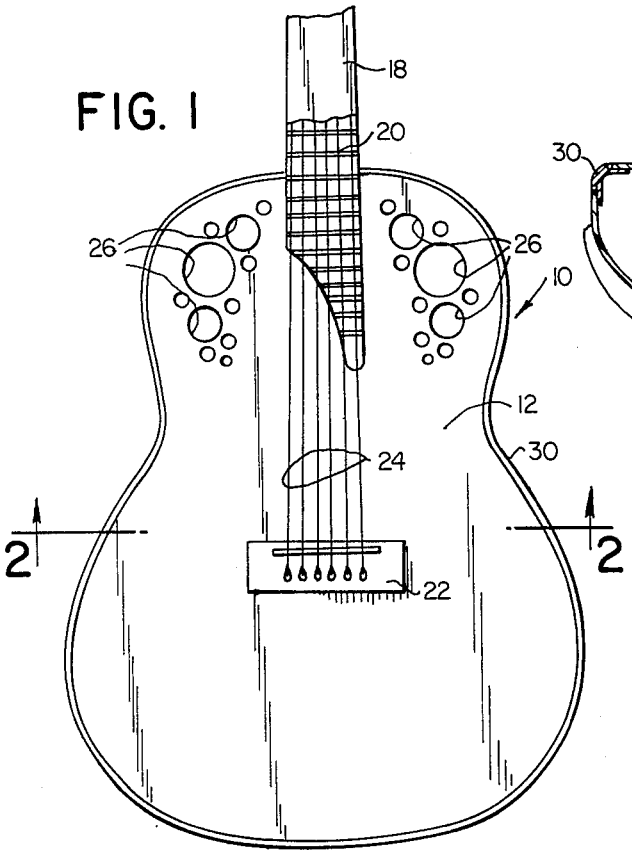
FIG. 1 is a plan view of a stringed musical instrument body embodying the present invention.
Figure 2:
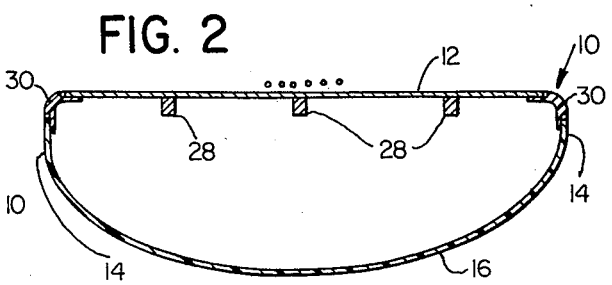
FIG. 2 is a transverse vertical sectional view taken on the line 2—2 of FIG. 1.

A guitar body embodying the present invention is indicated at 10 in FIGS. 1 and 2. It includes a top plate or soundboard 12 and a remaining or rear structure providing a sidewall 14. This remaining rear structure may take various different forms without departing from the invention, but in the illustrated case it consists of a one-piece rounded bowl 16, such as shown in prior U.S. Pat. No. 3,474,697, preferably made of a plastic material. Although not important to the invention, other features of the guitar shown in FIGS. 1 and 2 include a neck 18 carrying a fretted fingerboard 20, a combined bridge and tailpiece 22 attached to the top face of the top plate 12, a set of strings 24, a number of sound openings 26,26 in the top plate, and a plurality of braces 28,28 fixed to the inside or bottom face of the top plate.

In accordance with the invention, the top plate 12 is attached to the sidewall 14 by an elongated mounting member 30 which extends along the marginal edge of the top plate and resiliently supports such marginal edge from the sidewall 14 so as to allow it to vibrate in the vertical direction relative to the sidewall. The mounting member 30 in the direction of its longitudinal axis extends along substantially the entire length of the top plate marginal edge portion 32 and the adjacent upper portion 34 of the sidewall 14.

Figure 3:
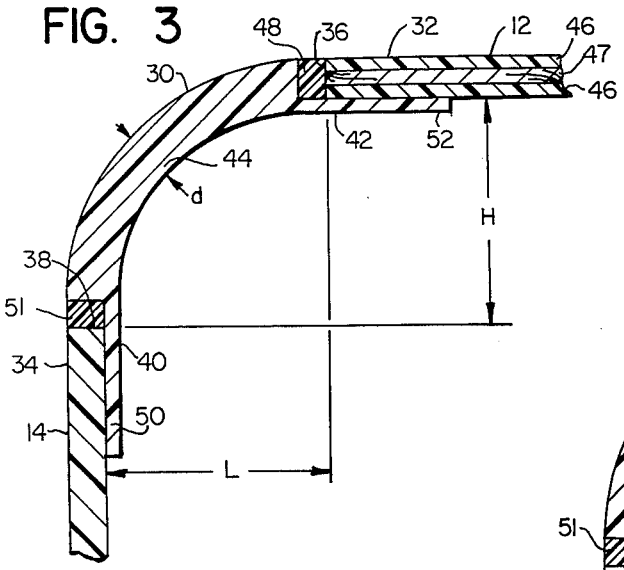
FIG. 3 is an enlarged fragmentary view of the upper left hand corner of the instrument body as seen in FIG. 2.

Referring to FIG. 3, taken on a plane perpendicular to the longitudinal axis of its mountng member, the top plate marginal edge 36 is space a substantial distance L inboard of the adjacent sidewall upper portion 34, and the top plate marginal portion 32 is likewise space a substantial distance H above the sidewall top edge 38. The mounting member 30 has an inboard longitudinal edge portion 40 fixed to the sidewall upper portion 34, an inboard longitudinal edge portion 42 fixed to the marginal edge portion 32 of the top plate, and an intermediate portion 44, of curved shape and of a substantially uniform thickness *d*, extending from the edge portion 40 to the edge portion 42.

In the illustrated case, the distances H and L are substantially equal and the mounting member intermediate portion 44 has an arcuate shape as seen in FIG. 3. Also as shown in FIG. 3, the top plate 12 is of a laminated consturction and may be one wherein the face plies 46,46 are made of a composite material consisting of graphite fibers and resin, and wherein its middle ply 47 is made of wood, as described in previously mentioned U.S. Pat. No. 3,880,040. A purfling strip 48 is inserted between the top plate marginal edge 36 and the mounting member portion 44, for decorative purposes, and a similar purfling strip 51 is also inserted between the upper edge 38 of the sidewall and the mounting member portion 44.

The inboard longitudinal edge portion 40 of the mounting member is in the form of a vertical lip 50 defining, with the thicker portion 44, a rabbet receiving the upper edge portion 34 of the sidewall and the purfling strip 51, the lip 50 being fixed to the upper edge portion 34 by a suitable adhesive. Likewise, the inboard edge portion 42 of the intermediate member 30 is in the form of a horizontally extending lip 52 adhesively secured to the marginal edge portion 32 of the top plate, the lip 52 with the portion 44 defining a rabbet for receiving the marginal edge portion 32 along with the associated purfling strip 48.

The thickness *d* of the mounting member portion 44 is relatively small in comparison to the distance L, and the material of the mounting member is such, so that the marginal edge portion 32 of the top plate may vibrate vertically relative to the sidewall 14 through accompanying resilient bending of the mounting member portion 44. Preferably the dimension *d* is substaintially less than one half the dimension L and the material of the intermediate member is a resilient moldable one consisting at least in part of plastic. For example, in a guitar body the dimension *d* may be approximately 0.075 inch, the dimension L may be approximately 0.250 inch and the material of the mounting member may be a composite material consisting of fiberglass fibers bonded in a resin matrix.

Figure 4:
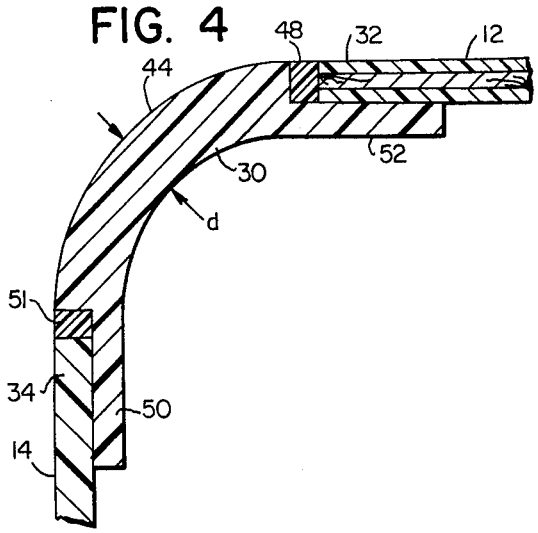
FIG. 4 is a view similar to FIG. 3 but shows the body with a mounting member of increased thickness.

From FIG. 3 it will be understood that by varying the dimension *d* of the intermediate portion 44 of the mounting member, the springiness of the mounting member, with respect to vertical vibration of the top plate marginal edge portion relative to the sidewall, may be varied by varying the dimension d. FIG. 4, for example, is similar to FIG. 3 except for showing a mounting member 30 in which the dimension *d* of its intermediate portion 44 is greater than the thickness of the corresponding portion of FIG. 3. Accordingly, the mounting member on FIG. 4 has greater rigidity, or less springiness, than that of FIG. 3.

Springiness of the mounting member 30 has an influence on the natural frequency of the top plate 12. Therefore, by matching a particular top plate with a mounting member having a particular thickness *d* (and accordingly a particular springiness) a given desired natural frequency of the top plate, as installed in the body, may be obtained.

Figure 5:
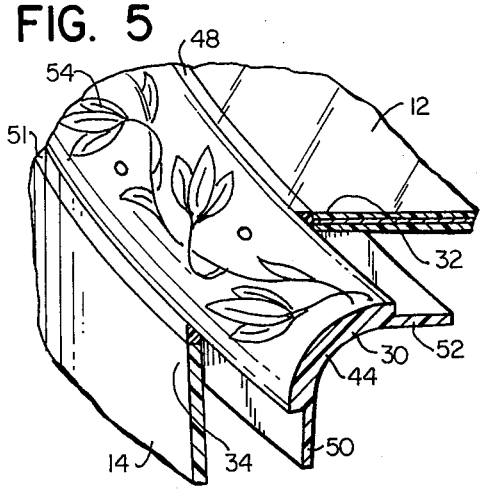
FIG. 5 is a fragmentary perspective view showing the construction of the joint between the top plate and the sidewall of the body of FIG. 1.

Further, the mounting member 30 of this invention, as will be evident from the drawing figures, has a rounded outside surface giving the edge of the instrument body, along the margin of the top plate, a comfortable rounded shape which contrasts with the corresponding sharp edge normally appearing on previous instrument bodies of conventional consturction. Also, the mounting member is preferably made as a one piece molded ring. Therefore, in the molding process for making it a decorative design, such as indicated at 54 in FIG. 5, may be readily molded into its outside surface.

I claim:

1. In a stringed musical instrument body having a generally vertical sidewall with an upper edge and a generally horizontal top plate with a marginal edge, the improvement consisting of a construction for resiliently attaching said top plate along its marginal edge portion to said sidewall so as to allow said marginal edge portion to vibrate relative to said sidewall, said construction comprising said marginal edge of said top plate being horizontally space along its length a substantial distance inboard of said upper edge of said sidewall, and a mounting member extending along the length of said upper side wall edge and said marginal top plate edge, said mounting member having an outboard longitudinal edge portion fixed to the upper edge portion of said sidewall, an inboard longitudinal edge portion fixed to said marginal portion of said top plate, and an intermediate portion extending substantially from said upper edge of said sidewall to said marginal edge of said top plate, said intermediate portion being resiliently flexible so as to permit said marginal edge portion of said top plate to vibrate vertically relative to said sidewall through accompanying bending of said intermediate portion of said mounting member, said marginal edge portion of said top plate being spaced vertically above said upper edge of said sidewall, and said intermediate portion of said mounting member in a vertical section perpendicular to its longitudinal axis curving upwardly from said upper edge of said sidewall and inwardly to said marginal edge of said top plate.

2. The improvement of claim 1 further characterized by said marginal edge portion of said top plate being spaced above said top edge of said sidewall by a distance H and said marginal edge top plate being spaced horizontally inboard of said upper edge portion of said sidewall by a distance L, said distance H and said distance L being approximately equal to one another and said intermediate portion of said mounting member in a vertical section perpendicular to its longitudinal axis being of an arcuate shape.

3. The improvement of claim 1 further characterized by said intermediate portion of said mounting member having substantially uniform thickness d which thickness d is substantially less than one-half said horizontal distance L.

4. The improvement of claim 3 further characterized by said mounting ring being made of a molded material consisting at least in part of plastic.

5. The improvement of claim 4 further characterized by said molded material being a composite material consisting of fiberglass fibers and resin.

* * * * *

UNITED STATES PATENT OFFICE

CERTIFICATE OF CORRECTION

Patent No. 4,090,427 Dated May 23, 1978

Inventor(s) Charles H. Kaman

It is certified that error appears in the above-identified patent and that said Letters Patent are hereby corrected as shown below:

Column 2, line 27, after "has" insert --a--.

Column 4, line 15, "consturction" should be --construction--.

Column 4, line 51, after "edge" insert --of said--.

Column 4, line 59, after "having" insert --a--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*